US006113231A

United States Patent [19]

Burr et al.

[11] Patent Number: 6,113,231

[45] Date of Patent: Sep. 5, 2000

[54] PHASE CHANGE INK PRINTING ARCHITECTURE SUITABLE FOR HIGH SPEED IMAGING

[75] Inventors: Ronald F. Burr, Wilsonville; Eric C. Segerstrom, Portland; Donald R. Titterington, Tualatin, all of Oreg.

[73] Assignee: Xerox Corporation, Stamford, Conn.

[21] Appl. No.: 09/045,216

[22] Filed: Mar. 19, 1998

Related U.S. Application Data

[63] Continuation-in-part of application No. 09/030,672, Feb. 25, 1998.

[51] Int. Cl.[7] ..... B41J 2/01

[52] U.S. Cl. ..... 347/103

[58] Field of Search ..... 347/103, 88

[56] References Cited

U.S. PATENT DOCUMENTS

| | | | |
|---|---|---|---|
| 4,889,560 | 12/1989 | Jaeger | 106/27 |
| 4,908,638 | 3/1990 | Albosta et al. | 347/43 |
| 4,940,998 | 7/1990 | Asakawa | 346/140 R |
| 5,099,256 | 3/1992 | Anderson | 347/103 |
| 5,172,138 | 12/1992 | Okazawa et al. | 347/104 X |
| 5,241,325 | 8/1993 | Nguyen | 346/1.1 |
| 5,372,852 | 12/1994 | Titterington | 427/288 |
| 5,389,958 | 2/1995 | Bui et al. | 347/103 |
| 5,428,375 | 6/1995 | Simon et al. | 347/12 |
| 5,475,409 | 12/1995 | Simon et al. | 347/74 |
| 5,477,254 | 12/1995 | Stephens | 347/74 |
| 5,488,397 | 1/1996 | Nguyen et al. | 347/40 |
| 5,534,895 | 7/1996 | Lindenfelser et al. | 347/19 |
| 5,592,202 | 1/1997 | Erickson | 347/37 |
| 5,677,719 | 10/1997 | Granzow | 347/103 |
| 5,696,541 | 12/1997 | Akahane et al. | 347/8 |
| 5,717,451 | 2/1998 | Katano et al. . | |
| 5,719,602 | 2/1998 | Hackleman et al. | 347/42 X |
| 5,724,077 | 3/1998 | Murata | 347/12 |
| 5,805,191 | 9/1998 | Jones et al. | 347/103 |

FOREIGN PATENT DOCUMENTS

| | | | |
|---|---|---|---|
| 2-136242 | 5/1990 | Japan | 347/103 |
| 5-004335 | 1/1993 | Japan | 347/103 |
| 5-229112 | 9/1993 | Japan | 347/103 |
| 93/07000 | 4/1993 | WIPO | 347/103 |

*Primary Examiner*—William J. Royer

*Attorney, Agent, or Firm*—Charles F. Moore; Francis I. Gray; Nola Mae McBain

[57] ABSTRACT

An apparatus and related method for high speed offset ink jet printing are provided. Multiple print head modules form a full width ink image by ejecting ink drops onto an intermediate transfer surface on a rotating drum. One or more complete images are formed on the intermediate transfer surface in less than one revolution of the drum. The images are then transferred to a final receiving medium while additional images are simultaneously formed on the intermediate transfer surface as the drum continues to rotate. Two or more color component images may be overlayed to form a complete color image in less than one revolution of the drum. Additionally, the simultaneous imaging and image transfer allow the apparatus and method to print images having a length greater than the circumference of the drum.

35 Claims, 6 Drawing Sheets

PHASE CHANGE INK PRINTING ARCHITECTURE SUITABLE FOR HIGH SPEED IMAGING

This Application is a Continuation-in-part of copending application Ser. No. 09/030,672, filed Feb. 25, 1998, the disclosure of which is incorporated into this document as if set forth fully herein.

FIELD OF INVENTION

This invention relates generally to an apparatus and method for high speed imaging in an ink jet printing system and, more specifically, to an apparatus and method that utilize multiple stationary print heads to print full color images by performing all of the printing process steps simultaneously.

BACKGROUND OF THE INVENTION

Ink jet printing involves ejecting ink droplets from orifices in a print head onto a receiving substrate to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly utilize either direct printing or offset printing architecture. In a typical direct printing system, ink is ejected from jets in the print head directly onto the final receiving substrate. In an offset printing system, an intermediate transfer surface, such as a liquid layer, is applied to a support surface, such as a drum. The print head jets the ink onto the intermediate transfer surface to form an ink image thereon. Once the ink image has been fully deposited, the final receiving substrate is then brought into contact with the intermediate transfer surface and the ink image is transferred and fused to the final receiving substrate.

U.S. Pat. No. 5,389,958 entitled IMAGING PROCESS and assigned to the assignee of the present application is an example of an indirect or offset printing architecture that utilizes phase change ink. The intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred and fixed (transfixed) to the final receiving surface by the pressure exerted on it in the nip.

One constraint with the architecture taught in the '958 patent is that each of the steps recited above must be performed in series, one after another. This greatly increases the time required to complete the printing process, and also limits the maximum length of an image to approximately the circumference of the drum. Additionally, the rotational speed of the drum during the transfix process must be considerably slower than the speed of the drum during the imaging process in order to fully transfer the ink image to the final receiving surface.

With regard to the imaging process, in many direct and offset printing systems the print head and the final receiving substrate or the intermediate transfer surface move relative to one another in two dimensions as the print head jets are fired. Typically, the print head is translated along an X-axis in a direction perpendicular to media travel (Y-axis). The final receiving substrate/intermediate transfer surface is moved past the print head along the Y-axis. In this manner, the print head "scans" over the medium/substrate and forms a dot-matrix image by selectively depositing ink drops at specific pixel locations. An example of this type of imaging process is disclosed in U.S. Pat. No. 5,949,452, entitled IMAGE DEPOSITION METHOD and assigned to the assignee of the present application. The '452 patent discloses an imaging process that utilizes multiple revolutions of the drum to deposit the complete ink image on the intermediate transfer surface. In the preferred embodiment, the drum rotates through 28 revolutions as the print head moves in an X - axis direction perpendicular to the drum travel direction to deposit the image. As with the architecture taught in the '958 patent, the maximum length of a given image is limited to the circumference of the drum.

To increase image density and allow for greater speeds, multiple print heads may be utilized. It is also known to utilize one or more stationary print heads to eliminate the necessity of scanning across the transfer surface or media. An example of a multiple stationary print head printer is disclosed in U.S. Pat. 5,677,719 entitled MULTIPLE PRINT HEAD INK JET PRINTER. FIG. 8 of the '719 patent shows an alternate embodiment suitable for color printing. Four separate ink jets are utilized, with each of the ink jets assigned to one of the four primary colors magenta, cyan, yellow, and black. To overlay two primary colors to achieve a secondary color, the '719 patent requires multiple revolutions of the drum. One color is applied during one rotation and another color is overlayed on the next rotation. In this manner, multiple revolutions of the drum are required to form a complete, solid fill full-color ink image on the intermediate transfer surface. It follows that the maximum length of a given image is limited to the circumference of the drum.

The '719 patent is directed to reducing the drying time of an ink droplet on the surface of the drum. More specifically, the '719 patent addresses the drying time required for an aqueous-based ink droplet to be cleanly transferred to the final receiving surface. A drying time of three seconds is disclosed, which translates to a maximum drum rotation speed of 20 revolutions per minute, corresponding to a maximum printing speed of 20 pages per minute.

As the above description illustrates, the speed of the printing architecture disclosed in the '719 patent is limited by the required drying times and the use of multiple drum revolutions for full-color printing. The maximum length of an image is also limited to the circumference of the drum. Thus, a need remains for a high speed ink jet printing system that overcomes the drawbacks of the prior art.

SUMMARY OF THE INVENTION

It is an aspect of the present invention to provide an apparatus and related method for high speed indirect ink jet printing.

It is another aspect of the present invention that the apparatus and method form an ink image on an intermediate transfer surface and transfer the image to a final receiving medium.

It is yet another aspect of the present invention that the apparatus and method form one or more complete images on the intermediate transfer surface and transfer the image(s) to the final receiving medium in a single pass.

It is a feature of the present invention that the apparatus and method are capable of printing full width images having at least a portion that is a solid fill image.

It is another feature of the present invention that the nozzles in one or more print head modules address every pixel location across a support surface in an X-axis direction, thereby allowing the print head modules to print a complete image in a single pass.

It is yet another feature of the present invention that the apparatus and method are capable of printing a complete image by overlaying two or more component images in a single pass, with each component image having a different color.

It is an advantage of the present invention that the apparatus and method perform all of the steps in the printing process simultaneously.

It is another advantage of the present invention that the apparatus and method are capable of printing images having a length greater than the circumference of the drum/support surface.

It is yet another advantage of the present invention that multiple complete images may be placed on the intermediate transfer surface in less than one revolution of the drum.

It is still another advantage of the present invention that the apparatus and method allow duplex printing.

To achieve the foregoing and other aspects, features and advantages, and in accordance with the purposes of the present invention as described herein, an apparatus and related method for high speed offset ink jet printing are provided. Multiple print head modules form a full width ink image by ejecting ink drops onto an intermediate transfer surface on a rotating drum. One or more complete images are formed on the intermediate transfer surface in less than one revolution of the drum. The images are then transferred to a final receiving medium while additional images are simultaneously formed on the intermediate transfer surface as the drum continues to rotate. Two or more color component images may be overlayed to form a complete color image in less than one revolution of the drum. Additionally, the simultaneous imaging and image transfer allow the apparatus and method to print images having a length greater than the circumference of the drum.

Still other aspects of the present invention will become apparent to those skilled in this art from the following description, wherein there is shown and described a preferred embodiment of this invention by way of illustration of one of the modes best suited to carry out the invention. As it will be realized, the invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
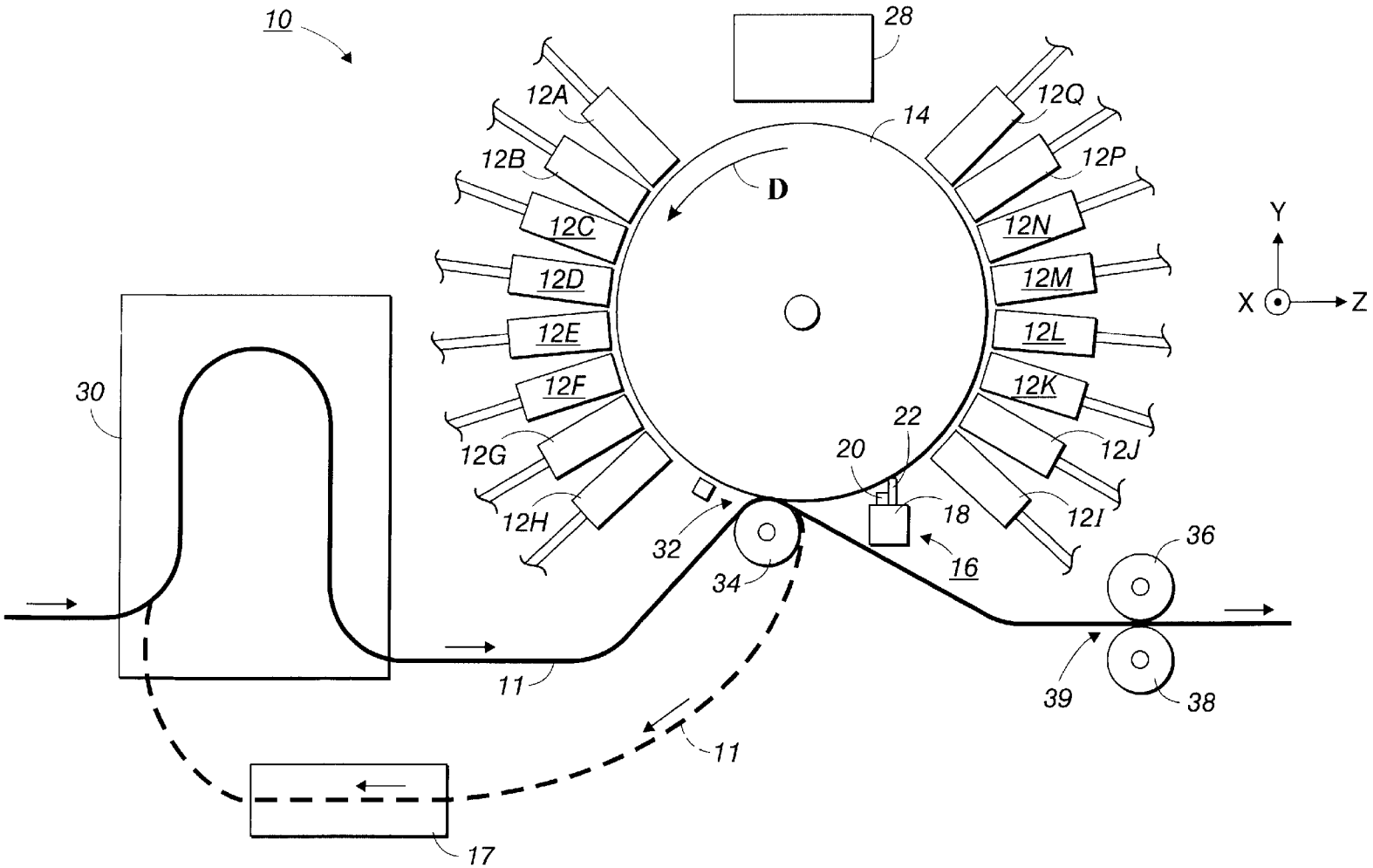
FIG. 1 is a diagrammatic illustration of a multiple print head offset ink jet printing apparatus that utilizes the apparatus and method of the present invention.

FIG. 1 is a schematic illustration of a preferred embodiment of a multiple print head, offset or indirect ink jet printing apparatus 10 according to the present invention. An example of an offset ink jet printer architecture is disclosed in U.S. Pat. No. 5,389,958 (the '958 patent) entitled IMAGING PROCESS and assigned to the assignee of the present application. The '958 patent is hereby specifically incorporated by reference in pertinent part.

Figure 2:
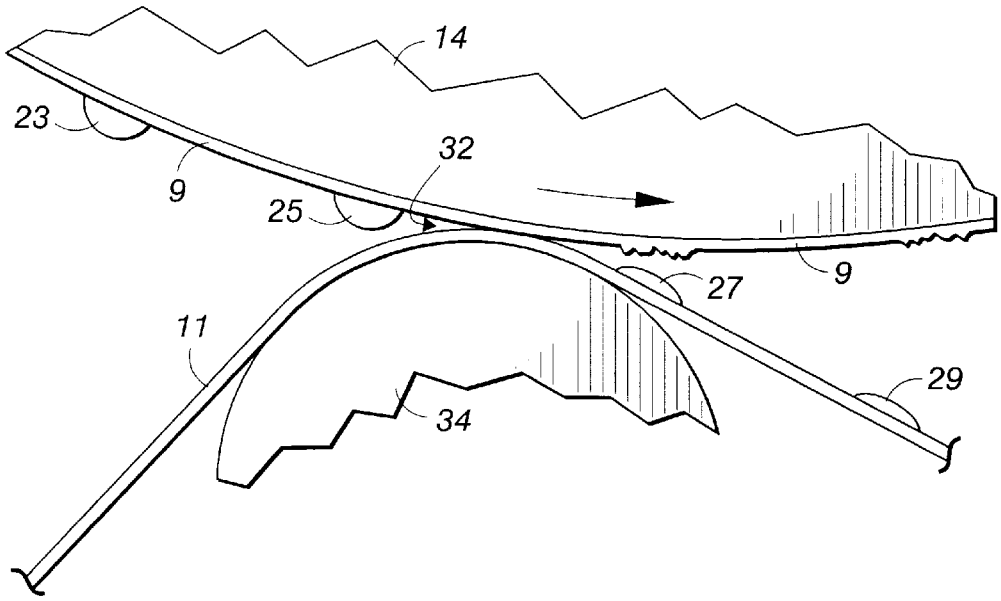
FIG. 2 is an enlarged diagrammatic illustration of the transfer of the inked image from the liquid intermediate transfer surface to a final receiving substrate.

The imaging apparatus 10 in FIG. 1 utilizes an offset printing process to place a plurality of ink drops in imagewise fashion on a final receiving substrate. In the preferred embodiment, the apparatus 10 includes 16 print head modules 12A–12N, 12P and 12Q positioned around a support surface or drum 14. With reference now to FIG. 2, the print head modules 12A–12N, 12P and 12Q jet drops of ink 23, 25 in a molten or liquid state onto an intermediate transfer surface 9 on the drum 14. The intermediate transfer surface 9 is preferably a liquid layer that is applied to the drum 14 by contacting the drum with an applicator assembly 16 (See FIG. 1). Suitable liquids that may be used as the intermediate transfer surface include water, fluorinated oils, glycol, surfactants, mineral oil, silicone oil, functional oils and combinations thereof. The preferred liquid is amino silicone oil.

As shown in FIG. 1, the applicator assembly 16 includes a reservoir 18, a wicking pad 20 for applying the liquid and a metering blade 22 for consistently metering the liquid on the surface of the drum 14. Wicking pad 20 is preferably formed from any appropriate nonwoven synthetic textile with a relatively smooth surface. A preferred configuration can employ the smooth wicking pad 20 mounted atop a porous supporting material, such as a polyester felt. Both materials are available from BMP Corporation as BMP products NR 90 and PE 1100-UL, respectively. The metering blade meters the liquid to have a thickness of from about 0.025 microns to about 60 microns, and more preferably from about 0.05 to about 10 microns. To allow continuous imaging and printing, the wicking pad 20 and blade 22 are continuously in contact with the drum 14. The reservoir 18 may also be supplied by a separate liquid supply system (not shown) to insure an uninterrupted supply of liquid.

The support surface may take the form of a drum 14 as shown in FIG. 1, or alternatively may be a belt, web, platen, or other suitable design. The support surface 14 may be formed from any appropriate material, such as metals including, but not limited to, aluminum, nickel or iron phosphate, elastomers, including but not limited to, fluoroelastomers, per fluoroelastomers, silicone rubber and polybutadiene, plastics, including but not limited to, polytetrafluoroethylene loaded with polyphenylene sulfide, thermoplastics such as polyethylene, nylon, and FEP thermosets such as acetals or ceramics. The preferred material is anodized aluminum.

Liquid or molten ink is ejected from the print head modules 12A–12N, 12P and 12Q onto the intermediate transfer surface 9 on the drum 14 to form an ink image thereon. A final receiving medium or media 11 is fed through a preheater 30 and into a transfer nip 32 formed between the drum 14 and a transfer roller 34. In the preferred embodiment, the transfer roller 34 has a metallic core, preferably steel, with an elastomeric covering having a 40–45 Shore D rating. Suitable elastomeric covering materials include silicones, urethanes, nitrites, EPDM and other appropriately resilient materials. With reference now to FIG. 2, the elastomeric covering on roller 34 engages the media 11 on the reverse side to which the ink image is transferred from the exposed surface of the intermediate transfer surface 9. As the media 11 passes through the nip 32, it is pressed against the deposited ink image to transfer the ink image to the media.

The pressure exerted on the ink image/media 11 within the transfer nip 32 should be sufficient to insure that the ink image is fully transferred to the media 11. FIG. 2 diagrammatically illustrates the sequence involved when drops of ink 23, 25, 27 and 29 forming the ink image are transferred from the liquid intermediate transfer surface 9 to the final receiving substrate 11. Returning to FIG. 1, additional processing of the transferred ink image on the media 11 may be accomplished by a pair of post-processing rollers 36, 38 downstream from the transfer nip 32. The post-processing rollers 36, 38 create a fusing nip 39 for fusing or fixing the ink image to the media. Preferably, the pressure within the fusing nip 39 is much greater than the pressure within the transfer nip 32. In this manner, the transfer nip 32 need only have sufficient pressure to transfer the ink image to the media 11, while the fusing nip 39 may utilize higher pressures to fuse or fix the ink image into the media 11. In the preferred embodiment, the pressure within the transfer nip 32 is between about 10 and about 1500 pounds per square inch (psi), and more preferably between about 100 psi to about 150 psi. The pressure within the fusing nip 39 is between about 10 and about 2000 psi, and more preferably between about 200 and about 250 psi.

Advantageously, by utilizing a lower pressure within the transfer nip 32, less force is exerted by the transfer roller 34 on the drum 14 during the imaging process. This reduces the likelihood of misalignment between the drum 14 and the print head modules 12A–12N, 12P and 12Q, particularly in the Y-axis direction, and thereby allows for greater consistency in image quality.

With continued reference to FIG. 1, a duplex unit 17 may also be utilized to flip the media and allow printing on both sides of the media. Alternatively, the printed media 11 may be fed from the transfer nip 32 to a second printing apparatus (not shown) where the second side of the media is printed. It will also be noted that the media 11 is shown as a continuous roll, but may also be individual sheets of media.

The liquid intermediate transfer surface 9 on the surface of drum 14 and the ink image deposited thereon are maintained within a predetermined temperature range by an appropriate heater device 28. Heater device 28 may be a radiant heater positioned as shown or, alternatively, positioned internally within the drum 14. Heater device 28 increases the temperature of the drum 14/ liquid intermediate transfer surface 9 from ambient temperature to between about 25° C. and about 70° C. or higher. This temperature is dependent upon the exact nature of the liquid employed in the intermediate transfer surface 9 and the composition of the ink. A more preferred temperature range is between about 45° C. to about 52° C.

In the preferred embodiment, a phase change ink is utilized in the printer 10. The phase change ink is initially in solid form and is then changed to a molten state by the application of heat energy to raise the temperature to about 85° C. to about 150° C. The molten ink is then applied in raster fashion from the nozzles 42 in the print head modules 12A–12N, 12P and 12Q to the exposed surface of the liquid intermediate transfer surface 9. The ink cools to an intermediate temperature and solidifies to a malleable state in which it is transferred to the final receiving surface 11 via the transfer nip 32. This intermediate temperature where the ink is maintained in its malleable state is between about 30° C. and about 80° C.

The ink used to form the ink image preferably has fluidic and mechanical properties that meet the parameters needed for high speed indirect printing at speeds of 100 ppm and higher. In particular, the viscosity of the ink in a molten state must be matched to the requirements of the print head modules utilized to apply it to the intermediate transfer surface 9. The viscosity of the molten ink must also be optimized relative to other physical and rheological properties of the ink as a solid, such as yield strength, hardness, elastic modulus, loss modulus, ratio of the loss modulus to the elastic modulus, and ductility. Additionally, the hardening time required for the molten ink drops on the intermediate transfer surface 9/drum 14 to reach a malleable state suitable for transfer must be sufficiently short to support the desired printing speed. For example, to allow a printing speed of 100 ppm, where the length of each page is approximately equal to the circumference of the drum 14, the hardening time of the ink drops on the intermediate transfer surface 9/drum 14 must be about 0.6 seconds or less.

A preferred phase change ink is comprised of a phase change ink carrier composition admixed with a phase change ink compatible colorant. More specifically, the preferred phase change ink carrier composition comprises an admixture of (1) at least one urethane resin; and/or (2) at least one mixed urethane/urea resin; and (3) at least one mono-amide; and (4) at least one polyethylene wax. A more detailed description of the preferred phase change ink is found in allowed co-pending U.S. patent application Ser. No. 09/013,410 ("the '410 application") entitled PHASE CHANGE INK FORMULATION CONTAINING A COMBINATION OF A URETHANE RESIN, A MIXED URETHANE/UREA RESIN, A MONO-AMIDE AND A POLYETHYLENE WAX, filed Jan. 26, 1998 and assigned to the assignee of the present application. The '410 application is hereby specifically incorporated by reference in pertinent part.

It will be appreciated that many other types of phase change inks having various compositions may be utilized with the present invention. Examples of suitable alternative inks are described in U.S. Pat. Nos. 4,889,560 (the '560 patent) and 5,372,852 (the '852 patent). The '560 patent and '852 patent are hereby specifically incorporated by reference in pertinent part. The inks disclosed in these patents consist of a phase change ink carrier composition comprising one or more fatty amide-containing materials, preferably consisting of a mono-amide wax and a tetra-amide resin, one or more tackifiers, one or more plasticizers and one or more antioxidants, in combination with compatible colorants.

In an important aspect of the present invention, all of the steps involved in the printing process are performed simultaneously, or in parallel, to maximize printing speed. More specifically, the steps of applying the intermediate transfer surface 9 to the drum 14, depositing the ink image on the intermediate transfer surface, heating the intermediate transfer surface/drum 14, preheating the media 11, transferring the ink image to the media and post-processing the ink image on the media are all performed simultaneously or in parallel. Additionally, and in another important aspect of the present invention, all of these steps are performed continuously, which allows multiple complete images to be placed on the intermediate transfer surface 9 in less than one revolution of the drum 14. As these images are transferred to the media, additional multiple complete images are simultaneously jetted onto the intermediate transfer surface 9. This also enables the drum 14 to rotate at a fixed speed during the entire printing process, thereby avoiding the necessity of slowing the drum for the transfix process or other step. Advantageously, by performing all of the steps in parallel and continuously imaging and transferring one or more complete images, the printing apparatus 10 may print at speeds above 50 pages per minute (ppm), and more preferably at 100 ppm and higher. In a preferred embodiment, four complete images are placed on the intermediate transfer surface 9 in less than one revolution of the drum, and the drum rotates at approximately 25 revolutions per minute (rpm) to give a printing speed of 100 ppm.

Alternatively, and in another important aspect of the present invention, the printing apparatus 10 may print images having a length greater than the circumference of the drum 14. As imaging and transfer occur simultaneously and continuously, an image of any length may be printed by the printing apparatus 10.

Figure 3:
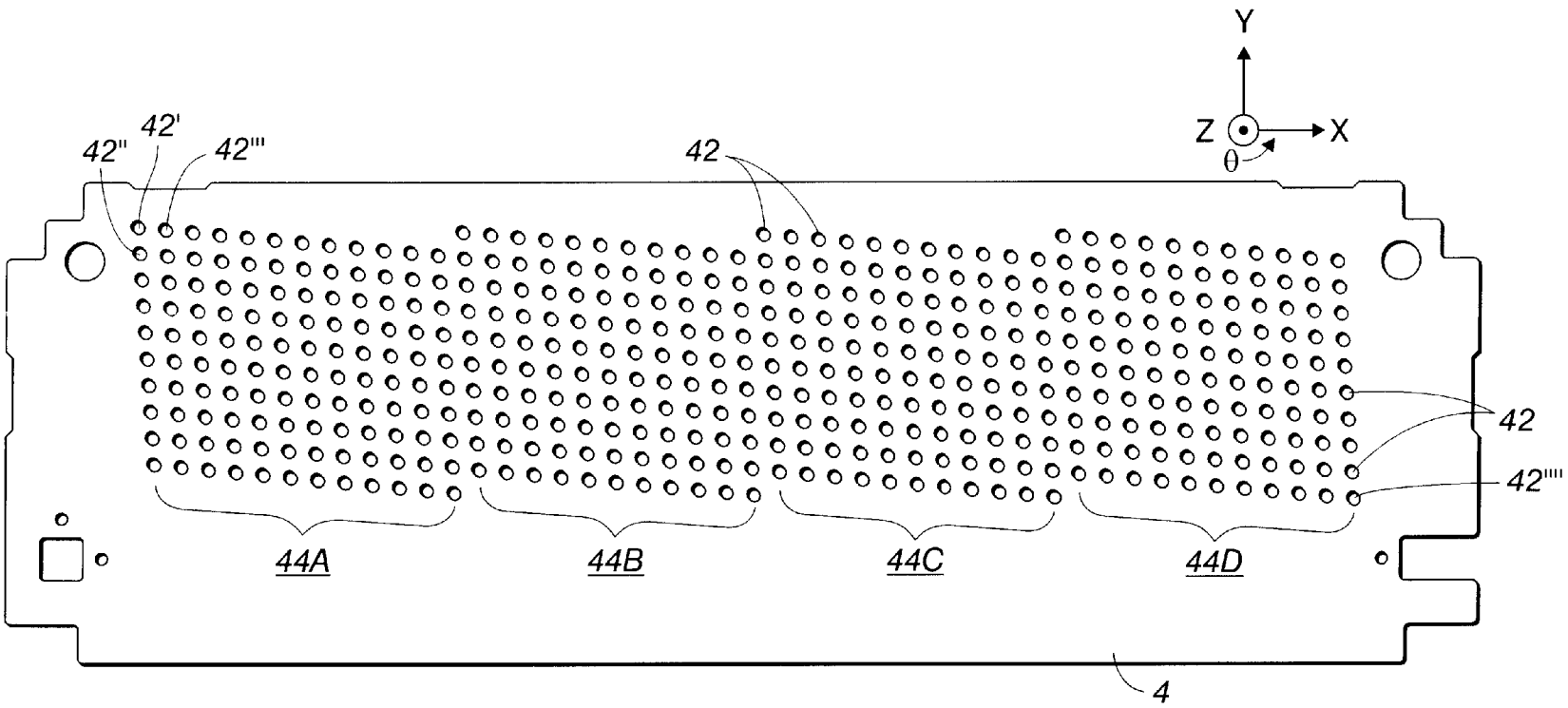
FIG. 3 is an enlarged elevational view of a print head module face plate having four arrays of ink jet nozzles for ejecting drops of ink.

With reference now to FIG. 3, the preferred embodiment of each print head module 12A–12N, 12P and 12Q will now be described. Each print head module includes a face plate containing a plurality of nozzles 42 through which the liquid ink drops are ejected. The face plate 4 in FIG. 3 corresponds to the print head module 12I in FIG. 1. The following discussion of face plate 4 applies equally to the face plates on each of the other print head modules. In the preferred embodiment, face plate 4 includes four arrays 44A–44D of nozzles 42. Array 44A is 12 nozzles across by 10 nozzles high, while arrays 44B–44D are each 11 nozzles across by 10 nozzles high. This configuration yields a total of 450 nozzles 42 on the face plate 4. As explained in more detail below, each nozzle 42 is positioned to address a different pixel location extending in the X-axis direction on the drum 14.

In the preferred embodiment the nozzles 42 are spaced apart vertically and horizontally by a distance of about 20 pixels, and each pixel has an approximate diameter or width of 1/300 inch (0.085 mm). The terms "horizontal" and "vertical" are used only in a general sense to indicate directions of reference, and should not be interpreted to refer to orthogonal directions. From the above description of the dimensions of the nozzle arrays 44A–44D, it will be appreciated that the face plate 4 can support 3 inch wide printing ((45 horizontal nozzles)×(1/15 inch between nozzles)=3 inches).

Figure 4:
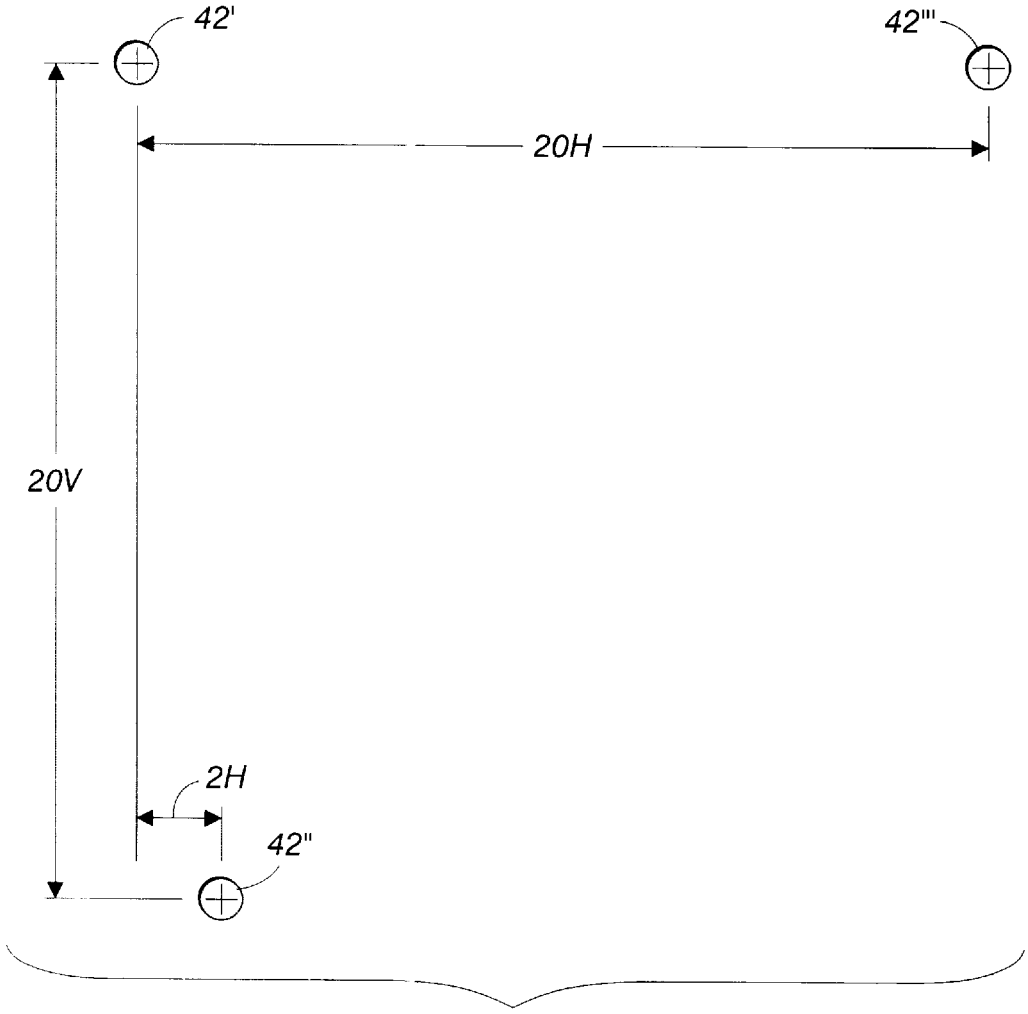
FIG. 4 is a greatly enlarged illustration showing the spacing between two horizontally adjacent nozzles and two vertically adjacent nozzles on the face plate.

FIG. 4 is a greatly enlarged illustration of horizontally adjacent nozzles 42' and 42''' and vertically adjacent nozzles 42' and 42''. It will be appreciated that the relative placement of nozzles 42', 42'' and 42''' is representative of the relative placement of any vertically or horizontally adjacent nozzles 42 on the face plate 4. As shown in FIG. 4, the horizontal centerline-to-centerline distance 20H between horizontally adjacent nozzles 42' and 42''' is 20 pixels. As discussed above, a pixel represents a single dot location within an image. The size or dimensions of a pixel will vary depending on the resolution of the image. The preferred embodiment described herein refers to printing at 300 dpi (118 dots per cm.), or 300 pixels per inch. Thus, each pixel will have an approximate diameter or width of 1/300 inch (0.085 mm.), and the above-referenced horizontal distance 20H of 20 pixels is equal to 1/15 inch.

With continued reference to FIG. 4, the vertical centerline-to-centerline distance 20V between vertically adjacent nozzles 42' and 42'' is 20 pixels, or 1/15 inch. As shown in FIGS. 3 and 4, the vertical rows of nozzles 42 are angled slightly. Preferably, the horizontal centerline-to-centerline distance 2H between vertically adjacent nozzles 42 is 2 pixels, or 1/150 inch (see FIG. 4). Alternatively expressed, vertically adjacent nozzles are offset by 2 pixels, or 1/150 inch.

With reference now to FIGS. 1 and 3, as the drum 14 moves past the face plate 4 of print head module 121, the nozzles 42 are selectively fired to place ink drops on the intermediate transfer surface on the drum. Given that vertically adjacent nozzles are horizontally offset by 2 pixels, a horizontal line printed by face plate 4 would have one pixel gaps between each printed pixel. Therefore, in an important aspect of the present invention, a second face plate 2 corresponding to print head module 12K is horizontally aligned to interleave with face plate 4 (see FIG. 5) to enable the printer 10 to print a complete, full width image in a single pass, or in less than one revolution of the drum 14. It will be appreciated that the present invention may also utilize a single, full width print head module that includes vertically adjacent nozzles that are horizontally offset by one pixel, thereby allowing this print head module to print full width, solid fill images in less than one revolution of the drum 14.

Figure 5:
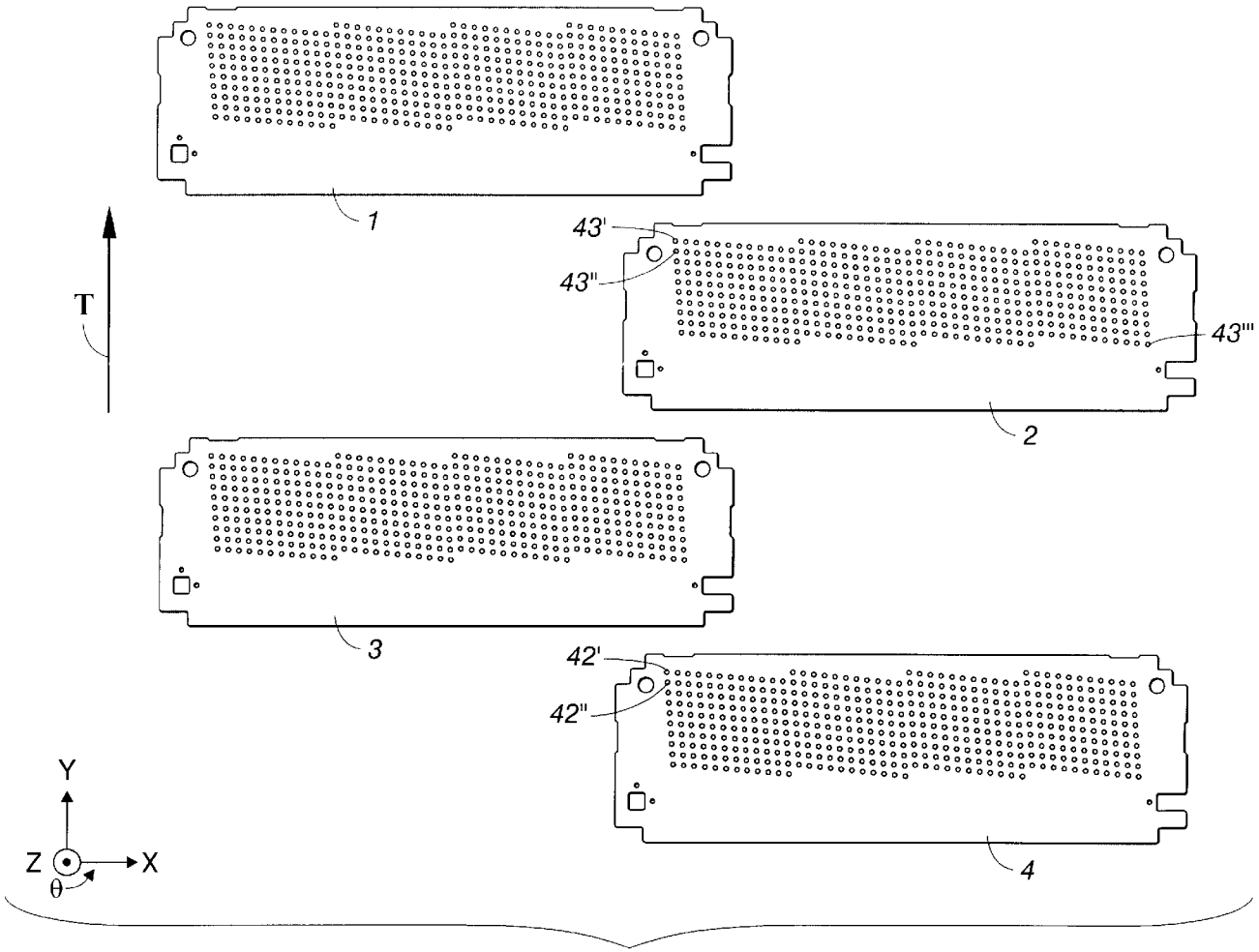
FIG. 5 is an elevational view of four face plates that are positioned to eject drops of ink that interleave with one another to form a solid fill image.
Figure 6:
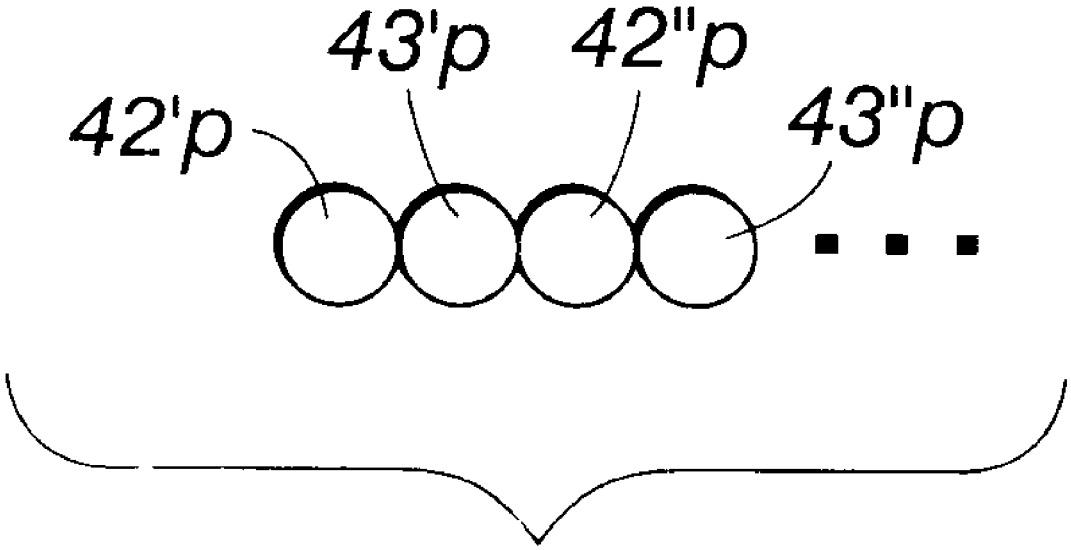
FIG. 6 is a schematic representation of a portion of a horizontal line printed by face plates 4 and 2 in FIG. 5.

More specifically, with reference to FIGS. 5 and 6, the nozzles in face plates 4 and 2 are horizontally offset by one pixel such that the one pixel gaps between vertically adjacent nozzles in face plate 4 are filled by the nozzles in face plate 2. FIG. 6 illustrates a portion of a horizontal line printed by face plates 4 and 2. Pixel 42'*p* is printed by nozzle 42' of face plate 4, pixel 43'*p* is printed by nozzle 43' of face plate 2, pixel 42''*p* is printed by nozzle 42'' of face plate 4, pixel 43''*p* is printed by nozzle 43'' of face plate 2, and so forth. In this manner, the nozzles 42 in face plates 4 and 2 are positioned to address every pixel location extending across the drum 14 in the X-axis direction between the leftmost nozzle 42' in face plate 4 and the rightmost nozzle 43''' in face plate 2 (see FIG. 5). Thus, face plates 4 and 2 are capable of printing a full width, solid fill image in a single pass, or less than one revolution of the drum 14. For the purposes of this application, a full width image is defined as an image that spans the X-axis distance between the leftmost and the rightmost nozzles 42 in a given arrangement of print head modules/face plates. A solid fill image is defined as an image or a portion of an image that is fully populated with ink pixels in the X-axis direction and the Y-axis direction.

As explained above, in the preferred embodiment each print head module/face plate is capable of 3 inch wide printing. A pair of horizontally aligned face plates, such as face plates 4 and 2, supports 3 inch wide printing at 300 dpi. With reference to FIG. 5, to enable the printer 10 to print 6 inch wide solid fill images, a second pair of horizontally aligned face plates 3 and 1, corresponding to print head modules 12J and 12L, respectively, are interleaved with face plates 4, 2. Preferably, the bottom four nozzles in the far right vertical row of face plates 3 and 1 interleave with the top four nozzles in the far left vertical row of face plates 4 and 2, respectively.

With reference now to FIGS. 1 and 5, in the preferred embodiment the printer 10 utilizes four colors of ink, cyan, magenta, yellow and black, for full color printing. Two interleaved pairs of print head modules/face plates, such as face plates 4, 3, 2 and 1, are dedicated to each of the four colors. Thus, the preferred embodiment of the printer 10 includes four sets of two interleaved pairs of print head modules/face plates for a total of 16 print head modules/face plates. Advantageously, the four sets of interleaved print head modules/face plates are aligned horizontally to print full color, 6 inch wide images. More specifically, each of the four interleaved pairs of print head modules/face plates prints a component image in one of the four colors. These four component images are overlayed as the drum rotates to form a complete, full color image on the intermediate transfer surface in less than one revolution of the drum. It will be appreciated that any number of print head modules/face plates may be interleaved to allow for greater image widths. For example, four pairs of print head modules/face plates may be interleaved for each color to support 12 inch wide printing. It will also be appreciated that any number of colors, such as two, three or four, may be utilized for printing with the present invention.

While the invention has been described above with references to specific embodiments thereof, it is apparent that many changes, modifications and variations in the materials, arrangements of parts and steps can be made without departing from the inventive concept disclosed herein. For example, while the preferred embodiment utilizes phase change ink, it is to be understood that the invention as described in the appended claims may be practiced with other types of inks, such as aqueous-based and solvent-based inks. Accordingly, the spirit and broad scope of the appended claims is intended to embrace the use of these other inks and all other changes, modifications and variations that may occur to one of skill in the art upon a reading of the disclosure. All patent applications and patents cited herein are incorporated by reference in their entirety.

What is claimed is:

1. A method of offset printing in an ink jet printer, the method comprising the steps of:

a) creating relative motion between a support surface and a plurality of print head modules;

b) applying a liquid to the support surface to form a liquid intermediate transfer surface on the support surface;

c) forming a portion of a complete ink image on the liquid intermediate transfer surface in a single pass between the support surface and the print head modules by applying drops of ink to the liquid intermediate transfer surface using a phase change ink having a hardening time on the liquid intermediate transfer surface approximately less than 0.6 seconds;

d) tranferring the portion of the complete ink image from the forming step to a final receiving medium; and e) performing steps a) through d) in parallel.

2. The method of claim 1, wherein the step of forming the portion of the complete ink image on the liquid intermediate transfer surface in a single pass further comprises the step of forming a full width image by addressing every pixel location across the support surface in an X-axis direction.

3. The method of claim 1, wherein the step of creating relative motion between the support surface and the plurality of print head modules further comprises the step of rotating the support surface, the support surface being an arcuate support surface, past the plurality of print head modules, and wherein the step of forming the portion of the complete ink image on the liquid intermediate transfer surface further comprises the step of forming the portion of the complete ink image within one revolution of the arcuate support surface, the forming and transferring steps occurring continuously until the complete ink image is transferred to the final receiving medium.

4. The method of claim 3, wherein the step of rotating the arcuate support surface further comprises the step of rotating the arcuate support surface at 20 revolutions per minute or faster.

5. The method of claim 3, wherein the step of rotating the arcuate support surface further comprises the step of rotating the arcuate support surface at a fixed speed during the performance of steps a) throygh d).

6. The method of claim 3, further comprising the step of positioning at least four of the plurality of print head modules at four different circumferential locations about the arcuate support surface.

7. The method of claim 3, further comprising the step of continuously urging a transfer roller against the arcuate support surface during the performance of steps a) through d).

8. The method of claim 1, wherein the step of forming the portion of the complete ink image on the liquid intermediate transfer surface in the single pass comprises the step of ejecting drops of phase change ink from the plurality of print head modules.

9. The method of claim 1, wherein the step of forming the portion of the complete ink image on the liquid intermediate transfer surface in the single pass comprises the step of forming a full width image having a portion being a solid fill image.

10. The method of claim 1, wherein the step of ejecting the drops of phase change ink from the plurality of print head modules further includes the step of ejecting the drops of ink at a temperature of about 85° C. to about 150° C. in a molten state onto the liquid intermediate transfer surface where the ink drops solidify into a malleable state having a temperature of between about 30° C. and about 80° C.

11. The method of claim 1, wherein the step of applying a liquid to the support surface further comprises the steps of:

contacting the support surface with an applicator; and metering the liquid on the support surface to form the liquid intermediate transfer surface.

12. The method of claim 11, wherein the step of metering the liquid on the support surface further comprises the step of metering the liquid to have a thickness of from about 0.025 microns to about 60 microns.

13. The method of claim 1, wherein the step of transferring the portion of the complete ink image to the final receiving medium comprises the step of passing the final receiving medium through a nip defined by the support surface and a transfer roller.

14. The method of claim 1, wherein the step of transferring the portion of the complete ink image to the final receiving medium comprises the steps of:

transferring the complete ink image to a first side of the final receiving medium; and transferring a second ink image to a second side of the final receiving medium.

15. The method of claim 1, further comprising the step of preheating the final receiving medium prior to transferring the portion of the complete ink image to the final receiving medium.

16. The method of claim 1, further comprising the step of mainatining the liquid intermediate transfer surface and the support surface within a predetermined temperature range.

17. A method of offset printing in an ink jet prinetr, the method comprising the steps of:

a) creating relative ,otion between a support surface and a plurality of print head modules;

b) applying a liquid to the support surface to form a liquid intermediate transfer surcae on the support surface;

c) forming two or more compltete ink images on the liquid intermediate transfer surface in a single pass between the support surface and the plurality of print head modules by applying drops of ink to the liquid intermediate transfer surface using a phase change ink having a hardening time on th eliquid intermediate transfer surface of approximately less than 0.6 seconds;

d) transferring the two or more complete ink images to a final receiving medium; and e) performing steps a) through d) in parallel.

18. A method of offset printing in a jet printer, the method comprising the steps of;

a) rotating an arcuate support surface;

b) applying a liquid to the arcuate support surface to form a liquid intermediate transfer surface on the arcuate support surface;

c) forming a portion of a complete ink image on the intermediate transfer surface within one revolution of the arcuate support surface by overlaying two or more component images, each of the component images having a different color using a phase change ink having a hardening time on the liquid intermediate transfer surface of approximately less than 0.6 seconds;

d) transferring the portion of the complete ink image to a final receiving medium; and e) performing steps a) through d) in parallel.

19. The method of claim 14, wherein the step of forming the portion of the complete ink image on the liquid intermediate transfer surface in one revolution of the arcuate support surface further comprises the step of forming a full width image by addressing every pixel location across the support surface in an X-axis direction.

20. The method of claim 18, wherein the step of forming the portion of the complete ink image on the liquid intermediate transfer surface within one revolution of the arcuate support surface comprises the step of forming a full width image having a portion being a solid fill image.

21. The method of claim 18, wherein the step of forming the portion of the complete ink image on the liquid intermediate transfer surface comprises the step of ejecting drops of phase change ink from a plurality of drop-on-demand ink jet print head modules.

22. The method of claim 21, further comprising the step of positioning at least four of the plurality of drop-on-demand ink jet print head modules at four different circumferential locations about the arcuate support surface.

23. The method of claim 22, wherein the step of applying a liquid to the arcuate support surface further comprises the steps of:

contacting the arcuate support surface with an applicator; and metering the liquid on the arcuate support surface to form the liquid intermediate transfer surface.

24. The method of claim 23, wherein the step of metering the liquid on the arcuate support surface further comprises the step of metering the liquid to have a thickness of from about 0.025 microns to about 60 microns.

25. The method of claim 23, wherein the step of ejecting the drops of ink from the plurality of drop-on-demand ink jet print head modules further includes the step of ejecting the drops of ink at a temperature of about 85° C. to about 150° C. in a molten state onto the liquid intermediate transfer surface where the ink drops solidify into a malleable state having a temperature of between about 30° C. and about 80° C.

26. The method of claim 18, wherein the step of rotating the arcuate support surface further comprises the step of rotating the arcuate support surface at 20 revolutions per minute or faster.

27. The method of claim 19, wherein the step of rotating the arcuate support surface further comprises the step of rotating the arcuate support surface at a fixed speed during the performance of steps a) through d).

28. The method of claim 18, wherein the step of transferring the portion of the complete ink image to the final receiving medium comprises the step of passing the final receiving medium through a nip defined by the arcuate support surface and a transfer roller.

29. The method of claim 28, further comprising the step of continuously urging the transfer roller against the arcuate support surface during the performance of steps a) through d).

30. The method of claim 18, further comprising the step of preheating the final receiving medium prior to transferring the portion of the complete ink image to the final receiving medium.

31. The method of claim 30, further comprising the step of maintaining the liquid intermediate transfer surface and the arcuate support surface within a predetermined temperature range.

32. The method of claim 18, wherein the step of transferring the portion of the complete ink image to the final receiving medium further comprises the steps of:

transferring the complete ink image to a first side of the final receiving medium; and transferring a second ink image to a second side of the final receiving medium.

33. A method of high speed, offset full color printing in an ink jet printer comprising the steps of:

a) creating relative motion at a fixed speed in a Y-axis direction between a continuous support surface having a length in the Y-axis direction and a plurality of print head moduled;

b) continuously applying a liquid to the continuous support surface to form a liquid intermediate transfer surface on the continuous support surface;

c) forming a full color ink image on the liquid intermediate transfer surface in a single pass between the continuous support surface and the print head modules by depositing drops of ink from the print head onto the liquid intermediate transfer surface wherein the full color image has a length in the Y-axis direction greater than the length of the continuous support surface so that a portion of the full color image is formed on the liquid intermediate transfer surface for each length of the continuous support surface and the forming and transferring step occur continuously until the full colr image is transferred to the final receiving medium;

d) transferring the full color image from the liquid intermediate transfer surface to a final receiving medium;

whereby the above process steps are performed simultaneously in parallel.

34. The method as recited in claim 33 wherein the forming step further comprises the step of forming a full width image on the liquid intermediate transfer surface by addressing with the print head modules every pixel location across the continuous support surface in an X-axis direction.

35. The method as recited in claim 33 wherein the continuous support surface is the surface of a drum with circumference of the drum being in the Y-axis direction and the plurality of print head modules being positioned circumferentially around the surface of the drum in the y-axis direction and across the width of the drum in an X-axis direction.

* * * * *